US009833082B1

(12) United States Patent
Rutkowski

(10) Patent No.: US 9,833,082 B1
(45) Date of Patent: Dec. 5, 2017

(54) PILLOW DRESSING SYSTEM

(71) Applicant: Loretta M. Rutkowski, Greensburg, PA (US)

(72) Inventor: Loretta M. Rutkowski, Greensburg, PA (US)

( * ) Notice: Subject to any disclaimer, the term of this patent is extended or adjusted under 35 U.S.C. 154(b) by 0 days.

(21) Appl. No.: 15/454,755

(22) Filed: Mar. 9, 2017

(51) Int. Cl.
*A47C 31/00* (2006.01)
*A47G 9/10* (2006.01)
*A47G 9/02* (2006.01)

(52) U.S. Cl.
CPC ..... *A47C 31/00* (2013.01); *A47G 9/0253* (2013.01); *A47G 9/10* (2013.01)

(58) Field of Classification Search
CPC ..... A47G 9/10
USPC ..... 5/489–490, 636, 639–640
See application file for complete search history.

(56) References Cited

U.S. PATENT DOCUMENTS

| | | | | |
|---|---|---|---|---|
| 359,617 | A | 3/1887 | Leonard | |
| 1,144,187 | A | 6/1915 | Garren | |
| 1,712,711 | A | 5/1929 | Morgan | |
| 5,239,741 | A | 8/1993 | Shamos | |
| 5,673,446 | A | 10/1997 | Moen | |
| 6,839,923 | B2 * | 1/2005 | Blessman | A47G 9/0253 5/489 |
| 7,958,580 | B2 | 6/2011 | Zorger | |
| 7,971,294 | B1 | 7/2011 | Murauskos | |
| 2006/0185086 | A1 | 8/2006 | Lucas | |

* cited by examiner

*Primary Examiner* — Frederick Conley

(57) ABSTRACT

A pillow dressing system includes a pillow case that has an open end. A pillow is provided and the pillow is selectively positioned within the pillow case. A panel is provided and the panel is selectively manipulated. The pillow is selectively positioned on the panel and the panel is selectively urged into the open end of the pillow case. In this way the pillow is selectively positioned within the pillow case. The panel is removed from the pillow case when the pillow is positioned within the pillow case.

5 Claims, 3 Drawing Sheets

PILLOW DRESSING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to dressing devices and more particularly pertains to a new dressing device for PURPOSE.

BRIEF SUMMARY OF THE INVENTION

An embodiment of the disclosure meets the needs presented above by generally comprising a pillow case that has an open end. A pillow is provided and the pillow is selectively positioned within the pillow case. A panel is provided and the panel is selectively manipulated. The pillow is selectively positioned on the panel and the panel is selectively urged into the open end of the pillow case. In this way the pillow is selectively positioned within the pillow case. The panel is removed from the pillow case when the pillow is positioned within the pillow case.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
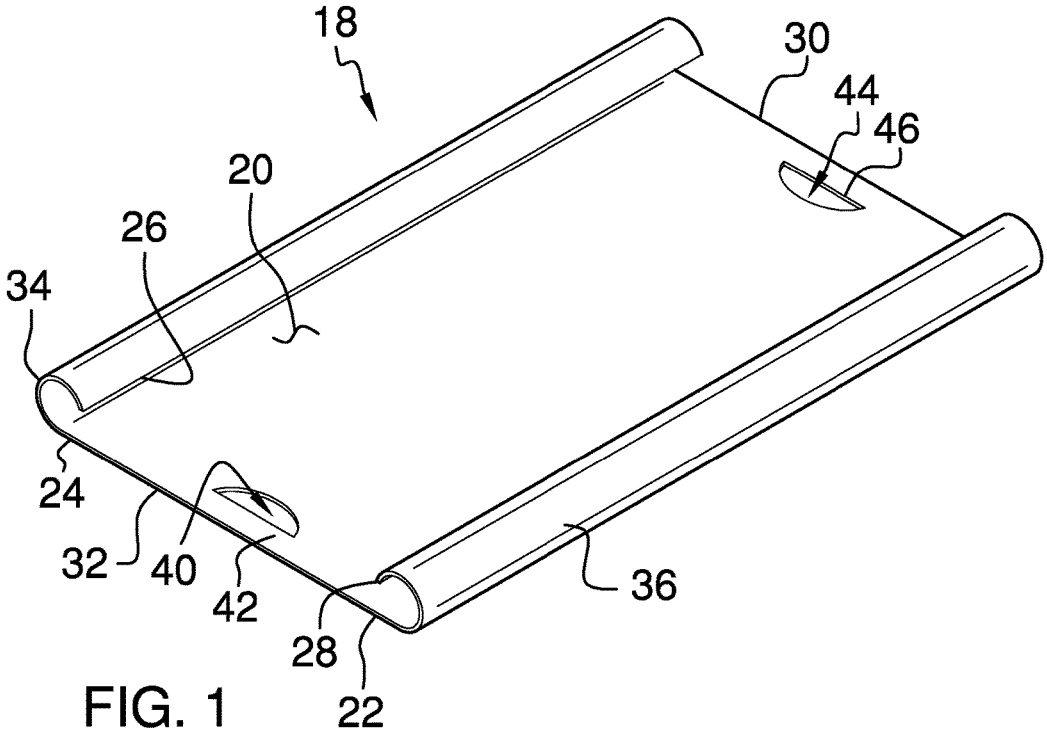
FIG. 1 is a top perspective view of a panel of a pillow dressing system according to an embodiment of the disclosure.
Figure 2:
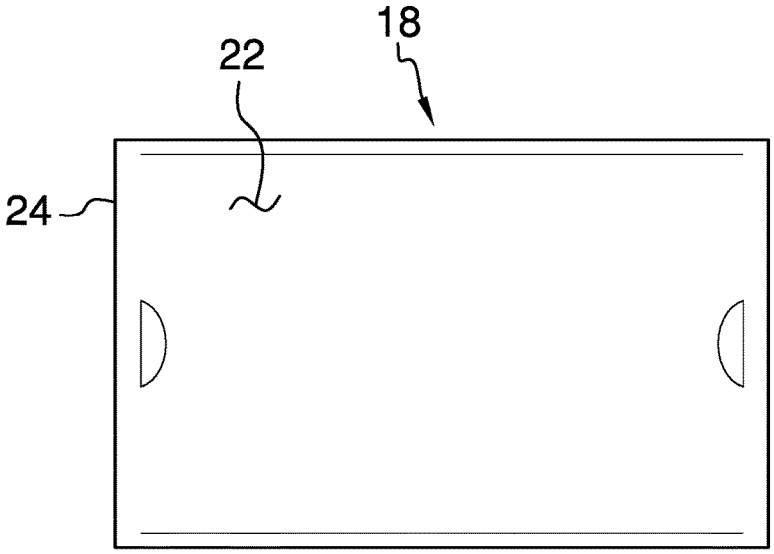
FIG. 2 is a bottom view of a panel of an embodiment of the disclosure.
Figure 3:
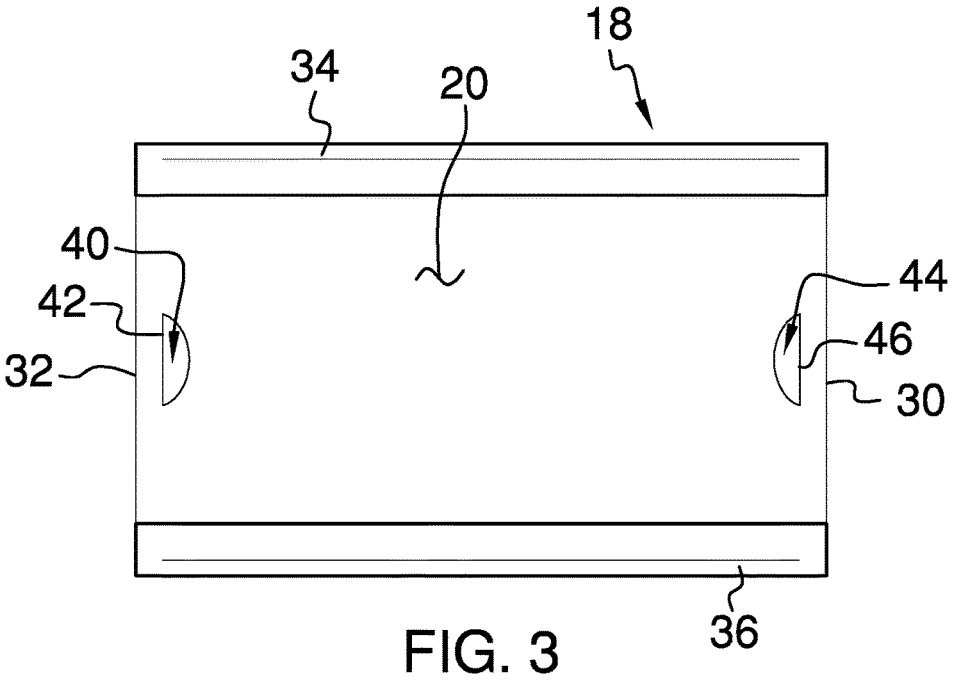
FIG. 3 is a top view of a panel of an embodiment of the disclosure.
Figure 4:
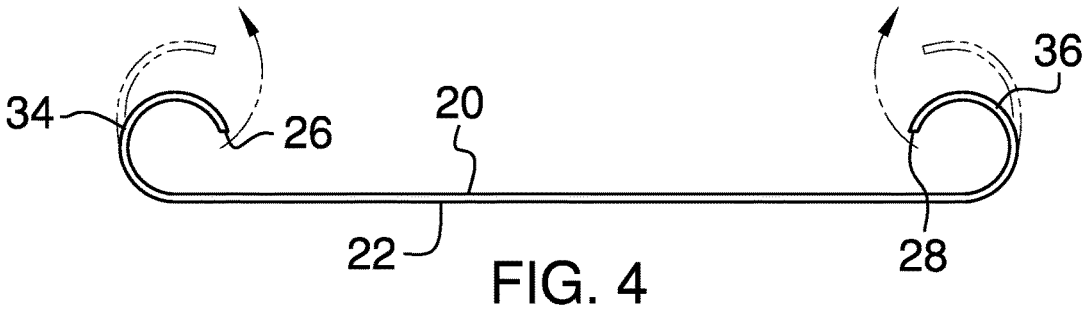
FIG. 4 is a front view of a panel of an embodiment of the disclosure.
Figure 5:
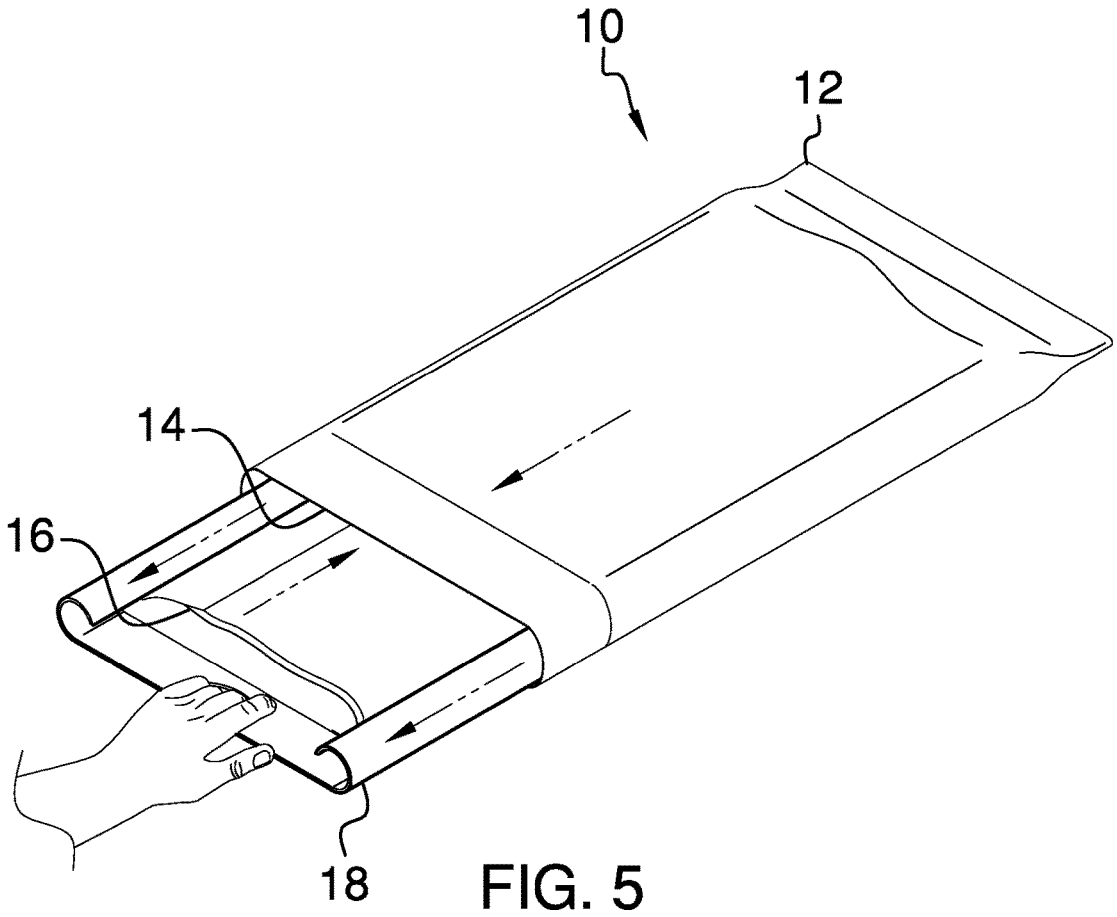
FIG. 5 is a perspective in-use view of an embodiment of the disclosure.

With reference now to the drawings, and in particular to FIGS. 1 through 5 thereof, a new dressing device embodying the principles and concepts of an embodiment of the disclosure and generally designated by the reference numeral 10 will be described.

As best illustrated in FIGS. 1 through 5, the pillow dressing system 10 generally comprises a pillow case 12 that has an open end 14 and a pillow 16 that is selectively positioned within the pillow case 12. The pillow case 12 may be a pillow case 12 of any conventional design and the pillow 16 may be a pillow 16 of any conventional design. Moreover, each of the pillow case 12 and the pillow 16 may be positioned on a bed or the like for sleeping.

A panel 18 is provided and the panel 18 is selectively manipulated. The pillow 16 is selectively positioned on the panel 18 and the panel 18 is selectively urged into the open end 14 of the pillow case 12. In this way the pillow 16 is positioned within the pillow case 12. The panel 18 is comprised of a resiliently flexible material. Moreover, the panel 18 inhibits the pillow case 12 from deforming the pillow 16 when the pillow 16 is inserted into the pillow case 12. In this way the panel 18 enhances positioning the pillow 16 in the pillow case 12. The panel 18 is removed from the pillow case 12 when the pillow 16 is positioned within the pillow case 12.

The panel 18 has a first surface 20, a second surface 22 and a peripheral edge 24 extending therebetween. The peripheral edge 24 has a first lateral side 26, a second lateral side 28, a front side 30 and a back side 32. The panel 18 has a first curl 34 extending between the front side 30 and the back side 32 and the first curl 34 is spaced from the first lateral side 26. In this way the first lateral side 26 is directed downwardly toward the first surface 20. The panel 18 has a second curl 38 extending between the front side 30 and the back side 32 and the second curl 38 is spaced from the second lateral side 28. In this way the second lateral side 28 is directed downwardly toward the first surface 20. The pillow 16 is selectively positioned on the first surface 20 such that each of the first curl 34 and the second curl 38 inhibits the pillow 16 from sliding laterally off of the panel 18.

A first opening 40 extends through the first surface 20 and the second surface 22 of the panel 18 to define a first handle 42 and the first handle 42 is selectively gripped. The first handle 42 is positioned closer to the front side 30 than the back side 32. A second opening 46 extends through the second surface 22 and the second surface 22 of the panel 18 to define a second handle 48 and the second handle 48 is selectively gripped. The second handle 48 is positioned closer to the back side 32 than the front side 30.

In use, the pillow 16 is positioned on the top surface of the panel 18. The panel 18 is manipulated to urge a selected one of the front side 30 and the back side 32 of the panel 18 into the open end 14 of the pillow case 12. Moreover, the panel 18 is fully inserted into the pillow case 12 thereby facilitating the pillow 16 to be fully inserted into the pillow case 12. Each of the first curl 34 and the second curl 38 engage opposite sides of the pillow case 12 when the panel 18 is inserted into the pillow case 12. In this way the pillow case 12 is inhibited from deforming the pillow 16 when the pillow 16 is inserted into the pillow case 12. The panel 18 is urged outwardly from the pillow case 12 and the pillow 16 is gripped to retain the pillow 16 in the pillow case 12.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A pillow dressing system comprising:

a pillow case having an open end;

a pillow being selectively positioned within said pillow case;

a panel being configured to be manipulated, said pillow being selectively positioned on said panel, said panel being selectively urged into said open end of said pillow case thereby facilitating said pillow to be positioned within said pillow case, said panel being removed from said pillow case when said pillow is positioned within said pillow case, said panel having a first surface, a second surface and a peripheral edge extending therebetween, said peripheral edge having a first lateral side, a second lateral side, a front side and a back side, said panel having a first curl extending between said front side and said back side, said first curl being spaced from said first lateral side such that said first lateral side is directed downwardly toward said first surface such that said first lateral side is configured for engaging said pillow between said first lateral side and said first surface whereby said pillow is inhibited from sliding off of said panel by said first lateral side, said panel having a second curl extending between said front side and said back side, said second curl being spaced from said second lateral side such that said second lateral side is directed downwardly toward said first surface such that said second lateral side is configured for engaging said pillow between said second lateral side and said first surface whereby said pillow is inhibited from sliding off of said panel by said second lateral side;

a first opening extending through said first surface and said second surface of said panel to define a first handle wherein said first handle is configured to be gripped, said first handle being positioned closer to said front side than said back side; and a second opening extending through said second surface and said second surface of said panel to define a second handle wherein said second handle is configured to be gripped, said second handle being positioned closer to said back side than said front side.

2. A pillow dressing system comprising:

a pillow case having an open end;

a pillow being selectively positioned within said pillow case;

a panel being configured to be manipulated, said pillow being selectively positioned on said panel, said panel being selectively urged into said open end of said pillow case thereby facilitating said pillow to be positioned within said pillow case, said panel being removed from said pillow case when said pillow is positioned within said pillow case, said panel having a first surface, a second surface and a peripheral edge extending therebetween, said peripheral edge having a first lateral side, a second lateral side, a front side and a back side, said panel having a first curl extending between said front side and said back side, said first curl being spaced from said first lateral side such that said first lateral side is directed downwardly toward said first surface such that said first lateral side is configured for engaging said pillow between said first lateral side and said first surface whereby said pillow is inhibited from sliding off of said panel by said first lateral side.

3. The system according to claim 2, wherein said panel having a second curl extending between said front side and said back side, said second curl being spaced from said second lateral side such that said second lateral side is directed downwardly toward said first surface such that said second lateral side is configured for engaging said pillow between said second lateral side and said first surface whereby said pillow is inhibited from sliding off of said panel by said second lateral side.

4. The system according to claim 2, further comprising a second opening extending through said second surface and said second surface of said panel to define a second handle wherein said second handle is configured to be gripped, said second handle being positioned closer to said back side than said front side.

5. The system according to claim 2, further comprising a first opening extending through said first surface and said second surface of said panel to define a first handle wherein said first handle is configured to be gripped, said first handle being positioned closer to said front side than said back side.

* * * * *